United States Patent [19]

Heiligtag et al.

[11] 4,315,700

[45] Feb. 16, 1982

[54] IMPLEMENT FOR APPLYING SEALANT TO ASPHALT PAVEMENT OR THE LIKE

[76] Inventors: Raymond W. Heiligtag, 1012 Palmer La., Imperial, Mo. 63052; Donald G. Heiligtag, 4696 Four Ridge Rd., House Springs, Mo. 63051; Donald R. Heiligtag, R.R. 2, Box 110I, Barnhard, Mo. 63012

[21] Appl. No.: 14,416

[22] Filed: Feb. 23, 1979

[51] Int. Cl.[3] ..... E01C 19/16

[52] U.S. Cl. ..... 404/111; 404/118; 172/439; 172/99

[58] Field of Search ..... 404/111, 118; 172/439, 172/447, 99

[56] References Cited

U.S. PATENT DOCUMENTS

| | | | |
|---|---|---|---|
| 905,190 | 12/1908 | Ingersoll | 404/111 X |
| 958,434 | 5/1910 | Price | 404/111 |
| 1,351,407 | 8/1920 | Smith | 404/111 X |
| 3,071,197 | 1/1963 | Larson | 172/99 |
| 3,183,803 | 5/1965 | Gierhart | 404/111 |
| 3,283,675 | 11/1966 | Gifford | 404/111 |
| 3,773,116 | 11/1973 | Coontz | 172/805 X |
| 3,940,213 | 2/1976 | Smith | 404/111 |
| 3,944,000 | 3/1976 | Lely | 172/439 X |
| 4,061,194 | 12/1977 | McCanse | 172/447 |

*Primary Examiner*—Nile C. Byers, Jr.

[57] ABSTRACT

An implement for use with a prime mover, such as a tractor, for applying a uniform coating of a liquid sealant to pavement comprising a plurality of spray tubes for spraying a coating of the liquid sealant onto the pavement and a rotary brush for brushing the sealant onto the pavement and for ensuring that a uniform coating of the sealant is applied to the pavement.

10 Claims, 2 Drawing Figures

IMPLEMENT FOR APPLYING SEALANT TO ASPHALT PAVEMENT OR THE LIKE

BACKGROUND OF THE INVENTION

This invention relates to an implement for applying a coating of a sealant (e.g. a coal tar emulsion or a sand filled asphalt) to asphalt pavement or the like.

More particularly, the implement of this invention is intended for use with a prime mover, such as a conventional tractor or the like, for the commercial application of a liquid sealant to asphalt pavement or the like. Heretofore, asphalt pavement was conventionally sealed by applying a coating of a coal tar emulsion, a sand filled asphalt, or other liquid sealant compound to the pavement. Typically, the sealant was manually spread by workmen using brushs and rubber squeegies. Not only did the manual application of the sealant require a significant amount of labor, but the sealant was oftentimes unevenly applied to the pavement. In certain instances, the sealant would appear to be evenly applied, but with the passage of time, it would become readily apparent that the sealant had been unevenly applied with resultant thin spots in which the sealant quickly wore away. In other instances, excessive amounts of the sealant would be used thus wasting sealant.

SUMMARY OF THE INVENTION

Among the several objects and features of this invention may be noted the provision of an implement usable with a conventional tractor or other prime mover for the uniform and rapid application of sealant to pavement;

The provision of such a sealant applying implement which forces the sealant into all voids in the pavement surface so as to ensure a continuous sealing of the pavement;

The provision of such an implement which, when installed on a tractor or prime mover, is readily maneuverable;

The provision of such an implement which is fully suitable to accommodate a wide variety of pavement and sealant conditions;

The provision of such an implement which provides the operator with excellent visability of the application of the sealant onto the pavement;

The provision of such an implement which may apply sealant to a large area of pavement without stopping and which maintains a uniform quality of the sealant being applied; and The provision of such an implement which is of rugged and economical construction, which is safe and reliable in operation, and which efficiently and rapidly applies the sealant thus saving considerable time, money, and labor in sealing the pavement.

Briefly, an implement of this invention is intended for the application of a liquid sealant or the like to a surface, such as asphalt pavement or the like. The implement comprises a frame adapted to be operatively coupled to a prime mover, such as a tractor. The frame extends generally transverse of the direction of travel of the prime mover. A plurality of spray tubes are spaced across the frame for spraying a liquid sealant onto the pavement surface. A so-called screed means is connected to the frame trailing the frame for engagement with the pavement surface for uniformly spreading the sealant on the surface as the prime mover moves forwardly. A tank is provided for holding a supply of the liquid sealant and a pump supplies liquid sealant under pressure to the spray tubes.

Other objects and features of this invention will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
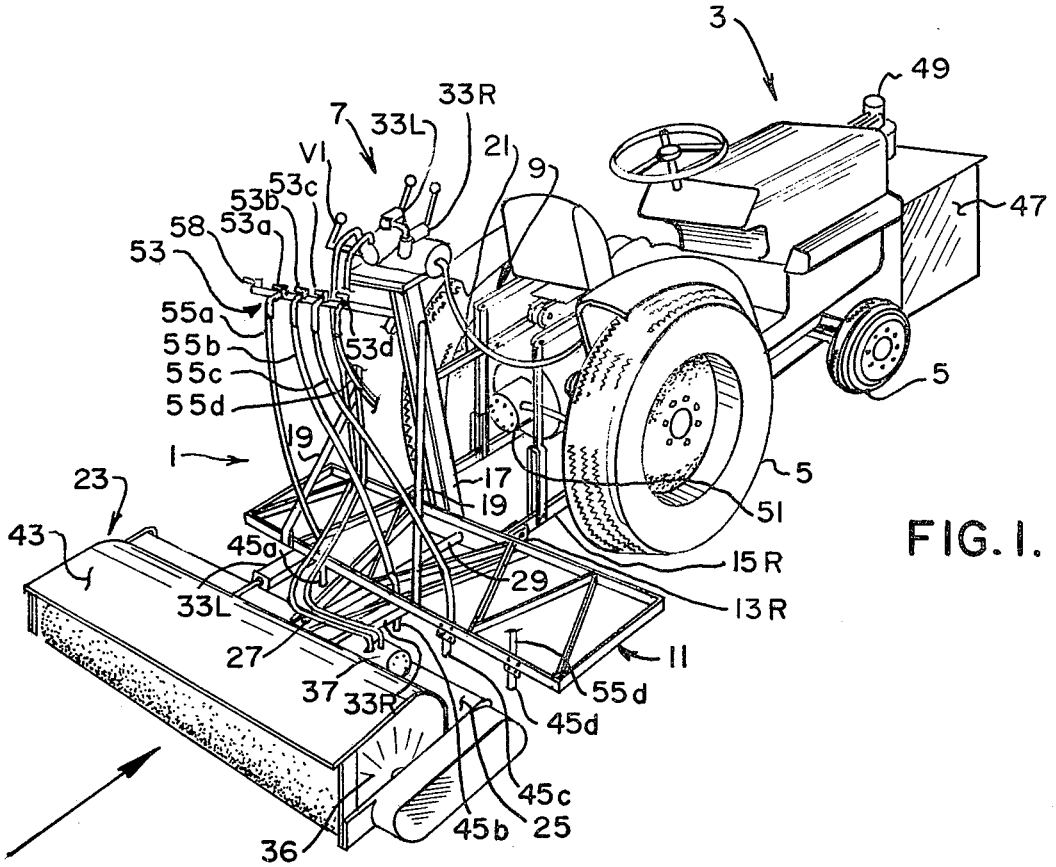
FIG. 1 is a rear perspective view of a prime mover (e.g., a tractor) having an implement of this invention attached thereto, the implement being in its operative position.

Referring now the drawings, an implement of this invention is shown in its entirety at 1 to be mounted on a prime mover (e.g., a tractor) 3. As illustrated, tractor 3 is shown to be a heavy-duty agricultural tractor, such as a Beaver (Model S-370) or a Bull S-630D commercially available from Satoh Company of Japan. These tractors are driven by either a 15 or 25 horsepower, water cooled, diesel engine and is rollingly supported on wheels 5. The tractor is equipped with an on-board hydraulic system, as generally indicated at 7, for supplying hydraulic fluid under pressure to various attachments or implements to be installed to the tractor, a power take-off shaft (not shown) at the rear of the tractor, and a hydraulically powered, catagory 0 or catagory 1, three point hitch 9. It will be understood that other tractors or prime movers may be readily used in place of the particular tractor herein described.

Implement 1 of this invention is intended for the application of a liquid sealant to a surface, such as for the application of a coal tar emulsion or an asphaltic sealant to asphalt pavement. Tractor 3 with implement 1 thereon is intended to move forwardly along a line of travel, as indicated by the arrow in FIG. 1. The implement includes a rigid frame 11 extending generally transversely of the direction of travel (i.e., from side-to-side of the tractor). This frame is shown to be a rigid weldment having clevis fittings 13R, 13L (see FIG. 2) on the front thereof for reception of draw bars 15R, 15L of tractor hitch 9 and having a generally vertical post 17 extending upwardly from the front of the frame, the post being braced as indicated at 19 in FIG. 1. Another link 21 of hitch 9 is pivotally attached to the post intermediate the top and bottom of the post. As will be appreciated, upon actuation of lift 9 of the tractor, frame 11 (and hence implement) may be readily raised and lowered between a lowered operative position (as shown in FIG. 1) and a raised retracted position.

Figure 2:
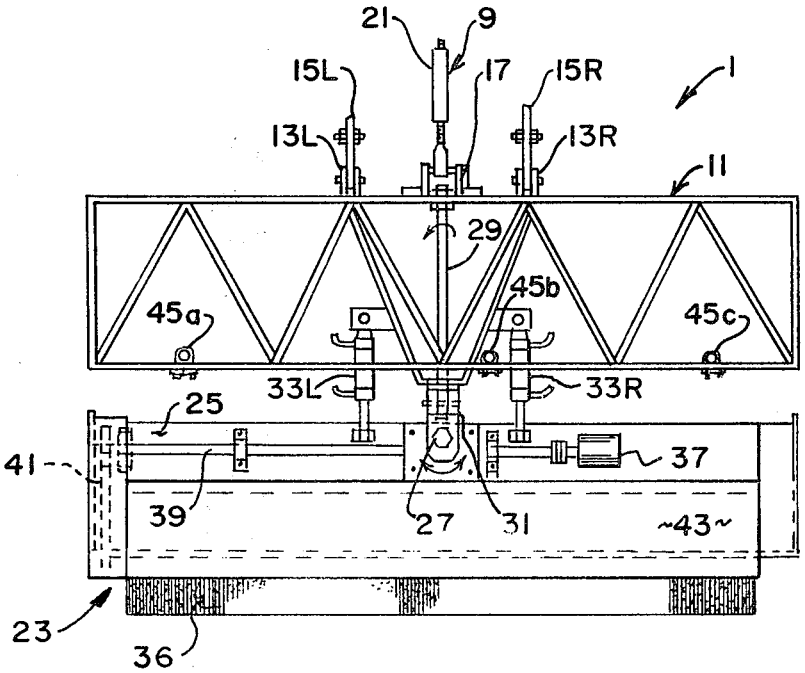
FIG. 2 is an enlarged plan view of the implement as it is attached to the prime mover.

As generally indicated at 23, a so-called screed or brush assembly is carried by frame 11 at the rear thereof. This last-mentioned assembly comprises a frame 25, the mid point of which is attached to frame 11 for rotation about the vertical axis of a pin 27 thereby to enable side-to-side swinging movement of the brush assembly on the pin. The brush assembly is pivotally connected to frame 11 by means of a horizontal shaft 29 journalled on frame 11 for rotation about a horizontal axis extending in the direction of travel of the tractor. By permitting brush assembly 23 to rotate about the above-noted horizontal axis, it will be appreciated that the brush assembly is free to "float" on the ground thereby to follow changes in the pavement surface independently of tractor 3 and frame 11. A clevis 31 is secured to the rear end of the shaft 29 for connection of brush frame 25 via pin 27. As best shown in FIG. 2, a pair of hydraulic cylinder units 33R, 33L is connected between frames 11 and 25 on opposite sides of shaft 29 to selectively swing the brush assembly relative to frame 11. Cylinder units 33R, 33L are selectively controlled by respective hydraulic control valves 34R, 34L which supply hydraulic fluid under pressure from the prime mover hydraulic system 7. By extending one of the cylinder units and by retracting the other, the brush assembly may be swung about the vertical axis of pin 27 so as to selectively change the angle of the brush relative to the line of travel of the tractor from a centered or neutral position (as shown in FIG. 2) in which the brush assembly is generally perpendicular with respect to the line of travel of the tractor to an angled position in which it is oblique with respect to the line of travel of the tractor.

Brush assembly 23 includes an elongate brush 36 journalled on brush frame 25 for rotation about its central longitudinal axis. The brush is preferably rotatably driven by a hydraulically powered brush motor 37 through a drive shaft 39 and a chain and sprocket drive 41. The brush preferably has a rigid elongate core extending the length of the brush and a plurality of elongate stiff bristles of polypropylene or other suitable bristle material. A shroud 43 extends up from brush frame 25 and at least partially encloses the brush so as to prevent the brush from slinging or splashing the liquid sealant during operation and so as to inhibit injury to workmen and other personnel. A plurality of spray tubes or nozzles 45*a*, 45*b*, 45*c* and 45*d* are mounted on frame 11 at intervals spaced therealong for spraying liquid sealant onto the pavement surface. A tank or reservoir 47 for storing a supply of the liquid sealant to be applied is mounted on the front of the tractor. For example, tank 47 may hold approximately 100 gallons of sealant. A sub frame (not shown) is provided which is adapted to be readily bolted or otherwise secured to the front of the tractor frame for holding tank 47 is position. A paddle type agitator (not shown) within the tank is driven by a hydraulic motor 49 for keeping the supply of liquid sealant within the tank well mixed thereby to ensure that the sealant applied is of a desired and uniform consistency and to ensure that solid materials within the sealant do not settle within the tank prior to application. A pump 51 is driven by the power take-off shaft of the tractor is provided for withdrawing sealant from tank 47 and for supplying the sealant under pressure to spray nozzles 45*a*, 45*b*, 45*c* and 45*d* for being sprayed onto the pavement. Preferably, pump 51 is a impeller displacement pump and may, for example, be capable of delivering 90 gallons per minute at 50 p.s.i. and is driven by the power take-off shaft of tractor 3. The pump supplies liquid sealant to the nozzles via a manifold assembly mounted on post 17. The manifold has a plurality of ball control valves 53*a*, 53*b*, 53*c* and 53*d* for selectively varying the flow of sealant to respective tubes 45*a*, 45*b*, 45*c* and 45*d* through hoses 55*a*, 55*b*, 55*c* and 55*d* and the flow of sealant to the manifold is controlled by a lever of P.T.O. drive. As noted above, four sealant applying tubes and nozzles are shown. However, it will be understood that, within the broader aspects of this invention, any desired number of tubes may be utilized.

In operation with tank 47 filled with a suitable sealant, with agitator motor 49 in operation, and with the tractor in position on a section of pavement to be sealed, the operator lowers implement 1 of this invention from its raised retracted position in which brush assembly 23 is raised above the pavement to a lowered operative position in which spray nozzles 45*a*, 45*b*, 45*c* and 45*d* are in position for spraying sealant onto the pavement and in which brush 36 is in brushing engagement with the pavement. The tractor is then driven in forward direction, as shown by the arrow in FIG. 1, and a control valve V1 on the top of post 17 is opened thereby to supply hydraulic fluid under pressure from the hydraulic system of the tractor to brush motor 37 to rotate brush 36. Tractor 3 is driven forwardly along a path on the pavement to be sealed at a desired velocity or rate of travel. The flow from the spray tubes is so adjusted as to apply a desired amount of sealant to the pavement at the particular rate of speed at which the tractor is traveling. The rotating brush 36 serves as a screed to uniformly distribute the sealant sprayed on the pavement by the spray tubes and to strike off excess sealant material across the entire width of the brush. The rotating bristles of the brush force the sealant material down into all voids and depressions in the pavement so that the penetration of the sealant into the pavement is not dependent on the mere gravity flow of the sealant on the pavement. By angling the brush to one side as by adjusting hydraulic cylinder units 33R, 33L, excess sealant material may be directed to one side of the section of pavement being coated on this first pass of the tractor. On the next pass of the tractor, the excess sealant material may be worked on to the pavement and thus is not wasted. By providing the tractor with right and left hand hydraulic cylinder 33R, 33L for rapidly changing the operating angle of the brush assembly, the angle of the brush assembly may be readily changed by the operator sitting in the driver's seat without removing himself from the seat. This is particularly advantageous in sealing large parking lots and the like where at the end of one pass the tractor merely can be turned around, the brush assembly changed from an angled position in which one end of the brush assembly is forward to an angled position in which the other end of the brush assembly is forward thus enabling the tractor to make a pass in the opposite direction.

As shown, implement 1 is mounted at the rear of tractor 3 so as to trail the tractor.

In view of the above, it will be seen that the several objects and features of the invention are achieved and advantageous results obtained.

As various changes could be made in the above constructions without departing from the scope of the invention, it is intended that all matter contained in the above description or shown in the accompanying drawings shall be interpreted as illustrative and not in a limiting sense.

We claim:

1. An implement or attachment for a tractor or other prime mover for the application of a liquid sealant to a pavement surface, said tractor having a 3-point hitch selectively movable between a raised and a lowered position for in turn raising and lowering said implement between a raised retracted position in which the implement is clear of the pavement surface and a lowered operative position, said implement having a frame adapted to be coupled to said tractor by means of said 3-point hitch, said frame extending generally transversely of the direction of travel of said tractor, a plurality of spray tubes spaced transversely along said frame for application of said liquid sealant to said pavement surface, a tank for holding a supply of said liquid sealant, a pump, conduit means interconnecting said tank, pump, and spray tubes for spraying of said liquid sealant under pressure onto said pavement surface, and a brush trailing said spray tubes rotatably driven about a horizontal axis and being engageable with said pavement surface for uniformly spreading said liquid sealant on said pavement surface and for forcing said sealing into cracks or voids in said pavement surface.

2. An implement as set forth in claim 1 wherein said brush is attached to said frame in such manner that it is free to rotate about a horizontal axis extending generally in the direction of movement of said tractor thereby to enable the brush to float on the pavement surface and to follow changes in the pavement surface independently of said tractor and said frame.

3. An implement as set forth in claim 1 wherein said brush is coupled to said frame in such manner that it is free to rotate relative to said frame about a vertical axis so that the angle of said brush with respect to the direction of travel of said tractor may be selectively changed.

4. An implement as set forth in claim 3 further including power operted means for selectively changing the angle of said brush with respect to said frame.

5. An implement as set forth in claim 4 wherein said tractor has a source of pressurized hydraulic fluid, and wherein said power operated means comprises at least one hydraulic cylinder and interconnected between said frame and said brush, said hydraulic cylinder unit being powered by said pressurized hydraulic fluid so as to change the angle to said brush with respect to said frame and said brush being securely held in a selected operative position by said hydraulic cylinder unit.

6. An implement as set forth in claim 5 further comprising valve means for selectively controlling said hydraulic cylinder unit.

7. An implement as set forth in claim 5 wherein said holding means comprises a pair of hydraulic cylinder units, one on each side of the pivotal connection between said screed means and said frame.

8. An implement as set forth in claim 1 further having valve means for selectively regulating the flow of sealant to said spray tubes.

9. An implement as set forth in claim 1 further comprising means for agitating said liquid sealant in said tank thereby to ensure that sealant of uniform quality is fed from the tank by said pump.

10. An implement as set forth in claim 1 wherein said tractor has power take off and wherein said pump is adapted to be driven by said power take off.

* * * * *